United States Patent [19]

Clark

[11] 4,349,201

[45] Sep. 14, 1982

[54] MAGNETIC DROP GAME

[76] Inventor: Melford D. Clark, 741 Piper La., Prospect Heights, Ill. 60070

[21] Appl. No.: 300,166

[22] Filed: Sep. 8, 1981

[51] Int. Cl.[3] ..... A63B 71/02; A63F 7/02

[52] U.S. Cl. ..... 273/400

[58] Field of Search ..... 273/398–402, 273/1 GD, 1 M

[56] References Cited

U.S. PATENT DOCUMENTS

| | | | |
|---|---|---|---|
| 2,590,002 | 3/1952 | Frazier | 273/1 GD X |
| 2,998,973 | 9/1961 | Schaper | 273/1 GD |
| 3,653,662 | 4/1972 | Welbourn | 273/1 GD X |
| 3,734,502 | 5/1973 | Bolton | 273/1 GD X |
| 4,183,533 | 1/1980 | Kulesza | 273/399 |

FOREIGN PATENT DOCUMENTS

| | | | |
|---|---|---|---|
| 962713 | 2/1975 | Canada | 273/400 |

*Primary Examiner*—Paul E. Shapiro
*Attorney, Agent, or Firm*—Edmond T. Patnaude

[57] ABSTRACT

A magnetic game includes a closed container having a transparent, multi-level dome which covers a base member having a plurality of upstanding pylons each having a ball receiving pocket in the top; a plurality of magnetic balls are loosely disposed within the container for movement by a hand-held permanent magnet from a plurality of magazine pockets surrounding the pylon area to a position on the dome over the pylons.

10 Claims, 3 Drawing Figures

MAGNETIC DROP GAME

The present invention generally relates to games of skill employing a hand-held permanent magnet for dropping magnetic balls into a target, and it relates more particularly to a game of that type which is economical to manufacture, which facilitates the picking up and dropping of the balls, and which limits the number of drops which can be made without resetting the game.

BACKGROUND OF THE INVENTION

Magnetic games of the general type to which this invention pertains are described in U.S. Pat. Nos. 2,339,209 and 3,734,502 and in my Canadian Pat. No. 962,713. In my earlier game nine pylons each having a ball receiving pocket in the top are arranged in three rows and three columns beneath a flat, transparent cover. That game was designed for playing tic-tac-toe and the pylons had different heights, with the center pylon being the shortest and thus requiring the greatest degree of skill because of the greatest drop distance from the flat cover.

In the prior art magnetic games using magnetic balls as the game pieces, magazine receptacles for holding the balls have been disposed below and in proximity to the transparent cover for selective pick up and movement over the target area by a hand-held permanent magnet. In that type of structure the spacing between the balls and the cover must be held within relatively close dimensional tolerances and the strength of the magnet must be maintained within predetermined limits to permit the player to selectively lift the balls out of the magazine receptacles and to then move them to the playing area over the targets. For example, if the spacing is too great the balls may not be picked up when the magnet is positioned above them. On the other hand, if the spacing is too small movement of the balls into and out of the magazine will be prevented.

SUMMARY OF THE INVENTION

Briefly, there is provided in accordance with the present invention a new and improved magnetic drop game having a dome-like cover located over a relatively flat molded base having a plurality of pocketed pylons integral therewith. In a preferred embodiment of the invention a wall or other stop means surrounds the pylons to provide a pit where played balls which miss the pockets in the pylons are collected. The surface of the base surrounding the wall slopes downwardly into a plurality of magazine receptacles which hold the unplayed balls in mutually spaced relationship in proximity to the side wall portions of the domed cover. Consequently, the critical spacing between the magazine and an overlying cover is eliminated, and the required strength of the permanent magnet is reduced. The wall prevents the balls which have once been played from moving into the magazine without inverting the entire games.

In another embodiment of the invention the base is inclined to cause the balls to gravitate to less than all directions, and in that case, the wall or other stop means is necessary only at the lower periphery of the target area to keep the played balls from rolling into the magazine receptacles.

The cover is provided with depressions at locations above the pylons for the purpose of relating the drop distance to the relative values of the respectively associated pylons and for strengthening and rigidifying the relatively thin cover which would otherwise be weak and flexible. Similarly, the sides of the cover are formed with flutes to strengthen the cover and to provide spaced, vertical passageways through which the balls may be selectively moved to the playing area over the pylons.

GENERAL DESCRIPTION OF THE DRAWING

The present invention will be better understood by a reading of the following detailed description taken in connection with the accompanying drawing wherein.

DETAILED DESCRIPTION OF THE INVENTION

Figure 1:
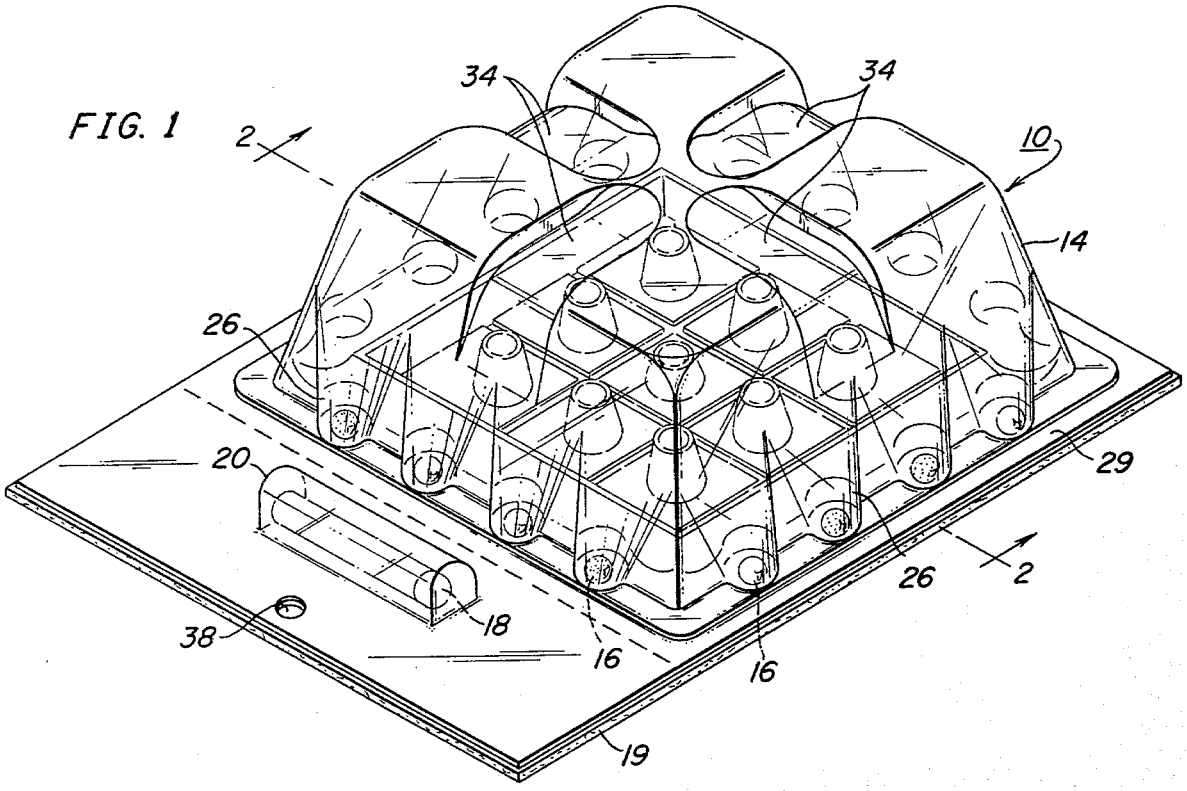
FIG. 1 is a perspective view of a magnetic game embodying the present invention.

As shown in the drawings, a magnetic game device 10 may be seen to comprise a generally non-magnetic base member 12 having a generally planar bottom surface, a transparent, non-magnetic, dome-like cover 14, a plurality of game pieces in the form of magnetic balls 16, and a hand-held, permanent magnet 18. To permit the playing of tic-tac-toe, half of the balls are one color, and the other half are a different color. In the illustrated embodiment of the invention the base member 12 and the cover 14 are mounted to a card 19 which provides a convenient hand-hold for use in holding the game when in use. In addition, the magnet 18 is mounted on the top surface of the card 19 by means of a plastic cover or blister 20 which overlies the magnet 18 and is bonded to the base. When first using the game device it is preferable to slice off one end of the blister 20 so that the remaining portion thereof can be used to store the magnet when the game is not in use.

Figure 2:
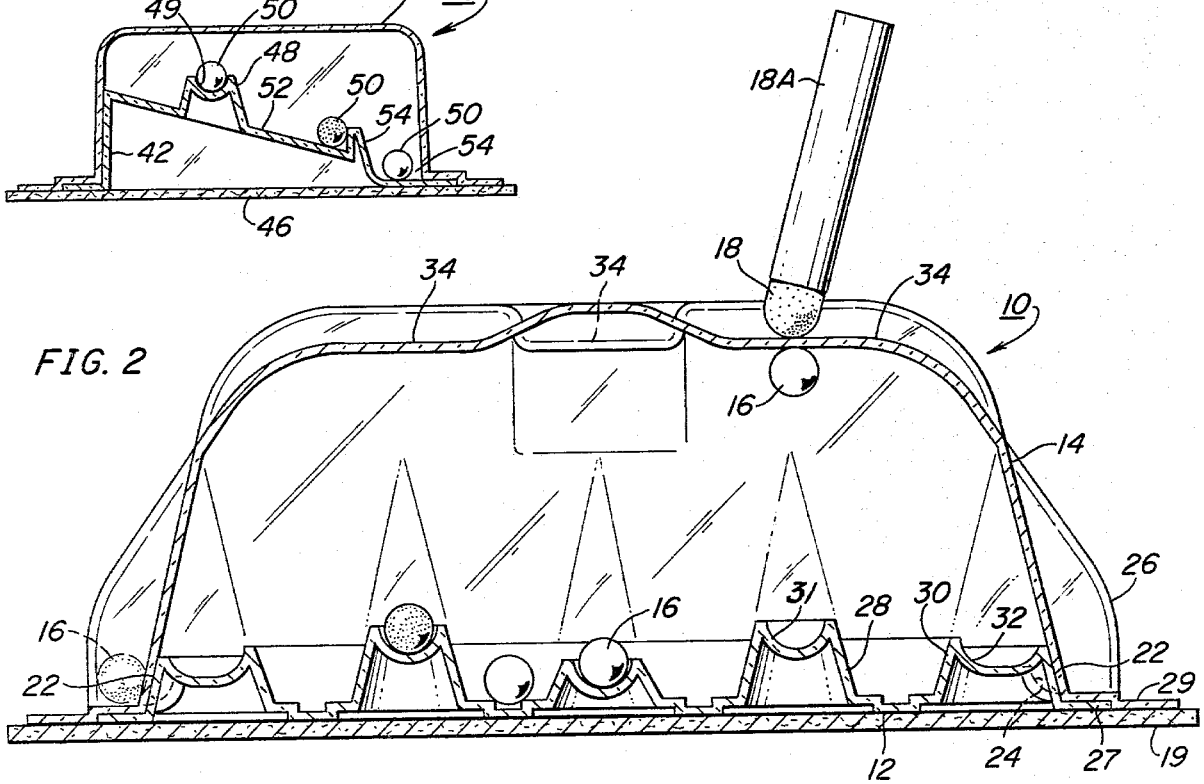
FIG. 2 is a cross-sectional elevational view of the game of FIG. 1 taken along the section line 2—2 thereof, and showing the game in use.

As may best be seen in FIG. 2, the base 12 is provided with an upstanding section over which the cover 14 is mounted. This section is square and has four upstanding side walls 22 having a plurality of spaced, semi-cylindrical recesses 24 therein. The radius of these recesses is a little larger than that of the balls 16. The cover 14 has four slightly tapered side walls each having a plurality of tapered flutes 26 respectively aligned with the recesses 24. At the bottom, the grooves provided by the flutes 26 have a radii equal to or greater than the radii of the recesses 24 thereby to provide a plurality of spaced, generally cylindrical receptacles for holding the unplayed balls 16.

The base 12 has a peripheral flange 27 which rests on the top surface of the card 19 beneath a peripheral flange 29 at the bottom of the cover 14. As shown best in FIG. 2, the flange 29 is stepped so that its lower surface closely conforms to the flange 27. The flange 29 is heat sealed or otherwise bonded to the card 19 thereby to lock the base 12 in place relative to the cover 14 in a single sealing operation.

Nine pylons 28, which are integral with the base, extend up toward the cover and are arranged in three rows and three columns. Each of the pylon 28 has a semispherical recess or pocket 31 at the top for receiving and holding a ball 16. The eight outside pylons are the same height while the center pylon is shorter. A stop means in the form of a raised wall 30 encloses the playing area which includes the pylons and is sufficiently high to prevent a ball 16 located inside the wall 30 from being moved outside the wall except by inverting or at least substantially tipping the game. Other stop means such as a moat can be used to surround the playing area and prevent the dropped balls from rolling into the magazine receptacles.

The portion of the base surrounding the wall 30 is identified by the reference character 32 and may best be seen in FIG. 2 to slope downwardly away from the wall so that any balls resting thereon will roll outwardly into respective ones of the recesses 24. When in the recesses 24 the balls 16 are very close if not actually touching the fluted portions 26 of the cover.

When the magnetic member 18, which may include a cylindrical, non-magnetic handle portion 18A, is placed adjacent a selected one of the balls in a recess 24 it attracts the ball against the adjacent inside surface of the cover 14. Then, when the magnet 18 is slid upwardly along the flute the ball is lifted out of the magazine recess and moved up the side of the cover. Continued sliding of the magnet 18 onto the top of the cover carries the ball into the playing area above the pylons 28. When the magnet 18 is then lifted away from the cover, the ball carried thereby is dropped and either falls into one of the pockets 31 or falls into the lower area enclosed by the wall 30.

The top portion of the cover 30 which overlies the playing area has four depressed areas 34 which are respectively located over the four outside center pylons. These depressed areas are connected to the respective side walls by smoothly curved surfaces so that a ball can be carried from a side wall onto the depressed surface without being inadvertently dropped. The four depressed areas reduce the drop distance to the associated pylons and they also rigidify the top of the cover. On the other hand, the top of the dome cover 14 may be flat and the corner pylons may be shorter than the center, outside pylons, but longer than the middle pylon.

It may be seen that the drop distance to the four outside center pylons is less than the other drop distances making it easier to drop a ball into the pockets 31 of the outside center pylons than into any of the others. The drop distance to the center pylon is greater while the drop distance to the corner pylons is in between. These drop distances correspond to the relative values of the pylon positions in the game of tic-tac-toe, that is the greater the drop distance, the higher the value. Also, the values relate proportionately to the number of tic-tac-toe possible through each position, four through the center, three through a corner and two through the side center.

The game device 10 may be used to play games other than tic-tac-toe. For example, different values may be assigned to the pylons, say twenty for the center pylon, fifteen for the corner pylon and ten for the outside center pylons. The game rules and other information may be printed on the portion 12A of the base, which is particularly suited for this purpose because of its flat surface. A hole 38 is also provided in the base portion 12A for hanging the game device on a display rack or the like.

Figure 3:
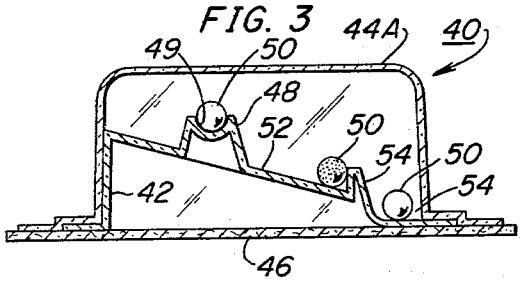
FIG. 3 is a cross-sectional view of another embodiment of the invention.

Referring to FIG. 3, a magnetic drop game 40 may be seen to comprise a base member 42, a dome-like cover 44 and a card 46. The base and cover are attached to the card 46 in the same way that the dome and cover of the game 10 are attached to the card 19.

The base 42 has a pylon 48 which has a pocket 49 at the top for receiving a magnetic gall 50. It will be understood that additional pylons having the same or different drop distances from the flat surface 44A of the cover may be provided. The portion of the base in the vicinity of the pylon 48 is designated 52 and slopes downwardly toward a magazine section 54 in proximity to one side wall of the cover 14. A stop means in the form of an upstanding wall 54 is positioned between the sloping surface 52 and the magazine section 54 to prevent the played balls from rolling under the force of gravity into the magazine from which they could be replayed.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A game device comprising in combination
a base member having at least one ball receiving target pocket,
a plurality of magnetic balls,
a dome-like, transparent cover secured over said base member and said target pocket, and
a plurality of ball receiving receptacles partially defined by said cover and located below said target pocket.

2. A game device according to claim 1 wherein
said cover is provided with a plurality of side walls having flutes defining internal grooves along which said balls may be moved from said receptacles to the top of said cover.

3. A game device according to claim 2 wherein
said receptacles are at least partially defined by said flutes.

4. A game device according to claim 3 wherein
said receptacles are at least partially defined by recesses in said base member.

5. A game device according to claim 1 wherein said base member comprises
stop means disposed between a playing area in which said target pocket is located and said receptacles.

6. A game device according to claim 5 wherein
said stop means comprises an upstanding wall.

7. A game device according to claim 6 wherein
said base member has a surface surrounding said wall,
said surface sloping downwardly to said receptacles.

8. A game device according to claim 5 wherein
said cover has a top portion overlying the portion of said base member enclosed within said stop means, and upstanding wall portions spacing said top portion from said base member.

9. A game device according to claim 8 wherein
said base member includes a plurality of said target pockets, and
said top portion of said cover is provided with a plurality of depressed areas overlying predetermined ones of said target pockets,
whereby the vertical distances between said target pockets and said cover differs from different ones of said pockets.

10. A game device according to claim 1 comprising
a flat card,
said cover having a peripheral flange bonded to said card, and
said base member having a peripheral flange held against said card by said cover.

* * * * *